United States Patent [19]

Zeimet

[11] Patent Number: 4,690,649

[45] Date of Patent: Sep. 1, 1987

[54] CENTER STERN OUTBOARD MOTOR MOUNT FOR DOUBLE-END CANOES

[76] Inventor: Richard E. Zeimet, 25 Wenchang St., Nantou, Taiwan, 540

[21] Appl. No.: 723,260

[22] Filed: Apr. 15, 1985

[51] Int. Cl.[4] ..... B63H 21/30

[52] U.S. Cl. ..... 440/6; 114/347; 440/900; 248/641

[58] Field of Search ..... 440/6, 49, 900; 114/61, 114/123, 347; 248/640, 641

[56] References Cited

U.S. PATENT DOCUMENTS

| | | | |
|---|---|---|---|
| 1,118,208 | 11/1914 | McLaren | 248/641 |
| 3,601,344 | 8/1971 | Nourse | 248/641 |
| 3,645,483 | 2/1972 | Bartosch et al. | 248/641 |
| 3,918,666 | 11/1975 | Florian | 248/641 |
| 4,371,144 | 2/1983 | Godlewski | 440/6 |

*Primary Examiner*—Jeffrey V. Nase
*Assistant Examiner*—Stephen P. Avila

[57] ABSTRACT

This invention, a Center Stern Outboard Motor Mount For Double-End Canoes, is useful for mounting an outboard motor on a double-end canoe of any type or make, and places the weight and thrust of the motor at center stern. This arrangement is safer and more energy efficient than the side clamping motor mounts often used on double-end canoes. This Motor Mount consists of a block of material, such as wood, to which an outboard can be clamped, that is fastened to a rigid piece of elongated material such as aluminum or fibre glass, with bends and curves so as to conform to the profile of the stern deck and the stem of the canoe for which it is made, and is fastened securely thereto by a selection of bolts, taut lines, hooks and a locking peg, according to the pecularities of the various stern designs of double-end canoes. In certain applications where it is not feasible to bolt the Mount directly to the stern deck of the canoe, it is bolted to an Accessory Deck Plate which is normally made of the same material as the Motor Mount. An Accessory Deck Plate conforms around the forward edge of the deck and is secured in place on the deck by two taut lines connected to the Deck Plate and to the lower rear section of the Motor Mount.

10 Claims, 10 Drawing Figures

CENTER STERN OUTBOARD MOTOR MOUNT FOR DOUBLE-END CANOES

This invention is a quickly and easily attachable and detachable OUTBOARD MOTOR MOUNT FOR DOUBLE-END CANOES, which places the weight and thrust of the outboard motor at center stern, as illustrated in the accompanying drawings (or similar articles so as to conform to the variously shaped sterns of the various types and makes of double-end canoes), made of suitable materials such as aluminum and wood or fibre glass and wood, and secured rigidly in place by:

(1) a bend at the forward end of the mount that conforms around the forward edge of the stern deck of the canoe;

(2) either (a) one or several bolts through the Mount and the stern deck (e.g. not used if it would entail puncturing an airtight flotation compartment), or (b) one or several bolts through the Mount and an Accessory Deck Plate secured forward on the stern deck under the Mount;

(3) a cutout in the Mount which seats around the converging point of the stern deck, gunwales and stem;

(4) either (a) a locking device (a strong peg or snap, etc.) inserted into the stern mooring ring which protrudes through a cutout of the Mount, so as to lock the Mount tightly against the stem, or (b) for canoes without a ring fixed to the stem, two taut lines (light cable or other suitable material) fastened on both sides at the lower rear section of the Mount, and either hooked over the gunwales at the two forward corners of the stern deck or fastened to an Accessory Deck Plate referred to in (2) (b) above.

BRIEF DESCRIPTION OF THE VIEWS OF THE DRAWINGS:

Drawing 1

Drawing 2

Figure 1:
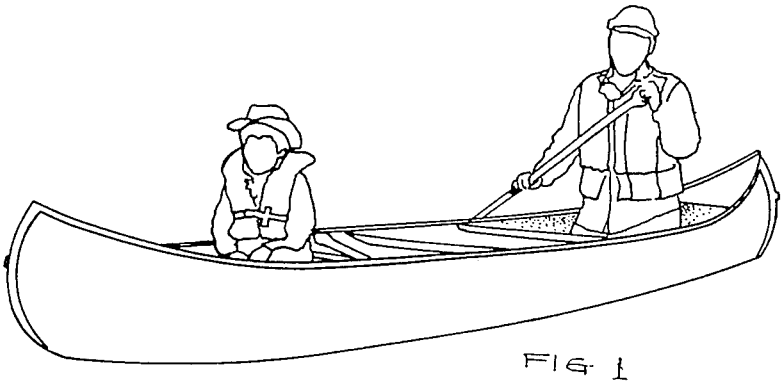
FIG. 1 is a perspective view of a typical double-end canoe.
Figure 2:
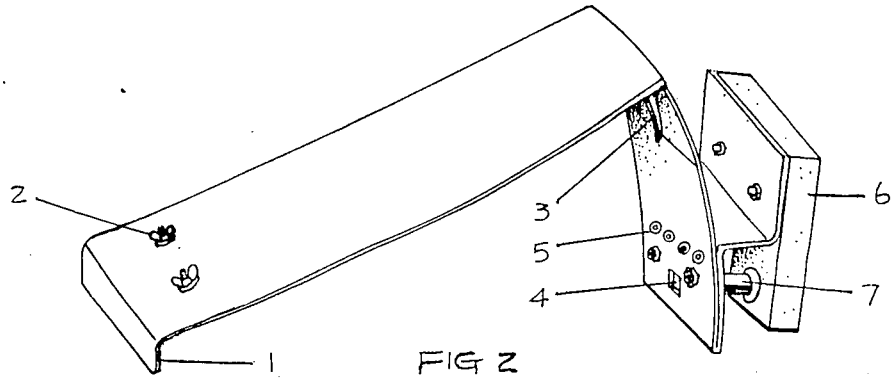
FIG. 2 is a perspective view of a typical Center Stern Outboard Motor Mount For Double-End Canoe.
Figure 3:
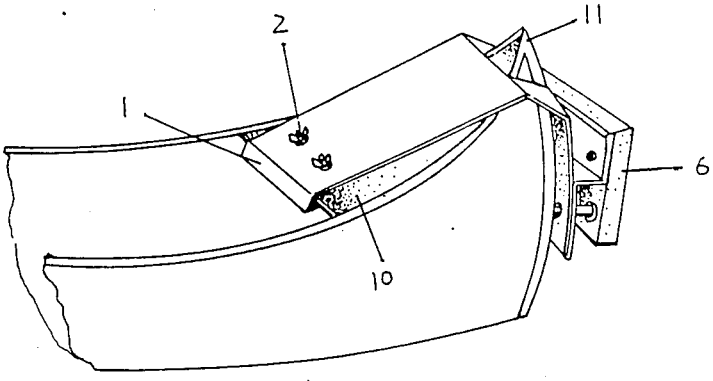
FIG. 3 is a perspective view of a typical Center Stern Outboard Motor Mount attached to a double-end canoe.
Figure 4:
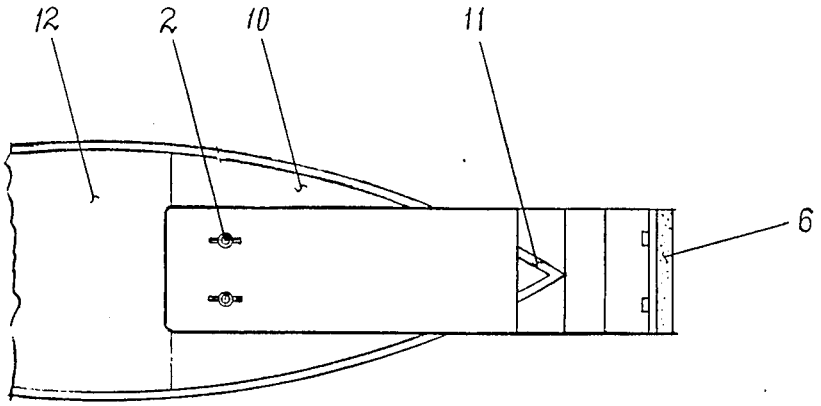

FIG. 4 is a plain top view of a typical Center Stern Outboard Motor Mount attached to a double-end canoe.

Figure 5:
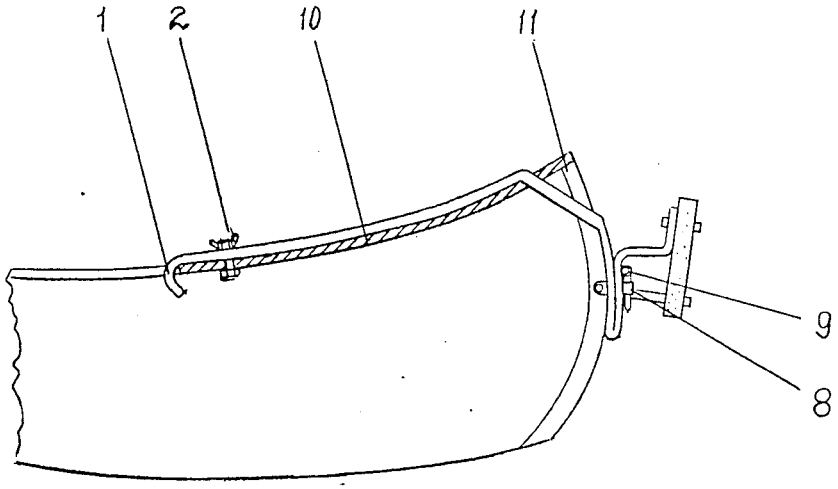

FIG. 5 is a plain side view of a typical Center Stern Outboard Motor Mount attached to a double-end canoe.

Drawing 3

Figure 6:
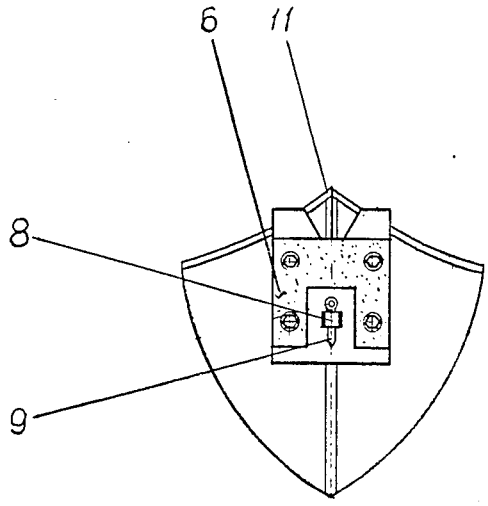

FIG. 6 is a plain rear view of a typical Center Stern Outboard Motor Mount attached to a double-end canoe.

Figure 7:
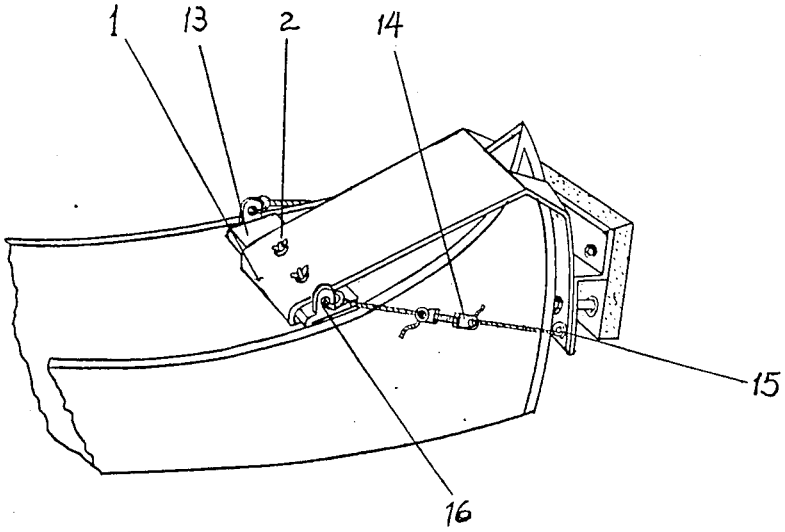

FIG. 7 is a perspective view of a typical Center Stern Outboard Motor Mount attached to a double-end canoe employing an Accessory Deck Plate and two taut lines to secure the Deck Plate in place on the deck.

Drawing 4

Figure 8:
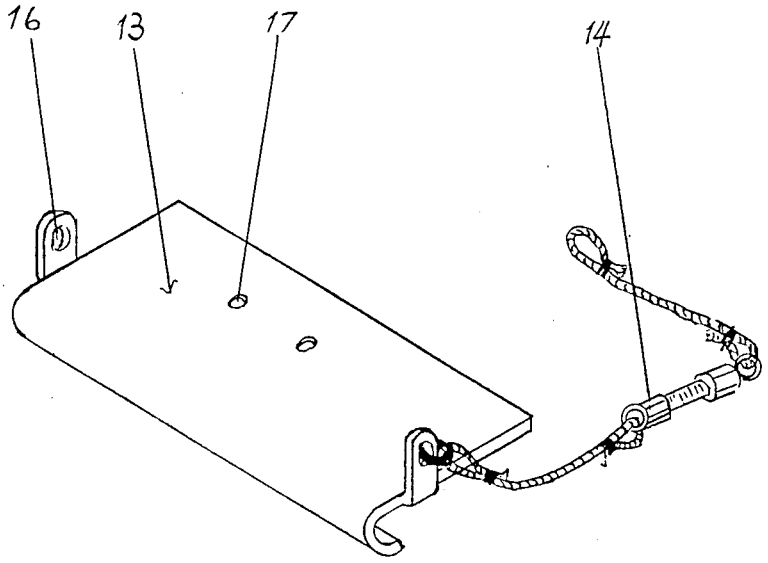

FIG. 8 is a perspective view of a typical Accessory Deck Plate.

Figure 9:
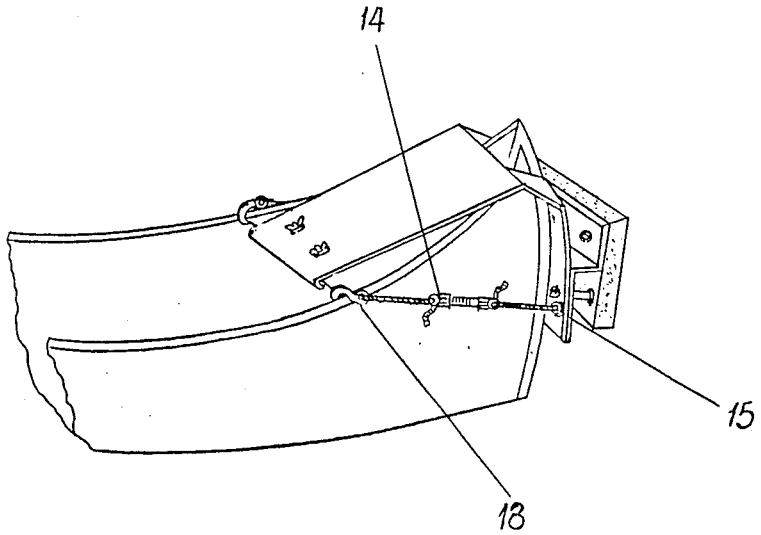

FIG. 9 is a perspective view of a typical Center Stern Outboard Motor Mount attached to a double-end canoe employing two taut lines hooked over the gunwales to secure the rear section of the Motor Mount tightly against the stem on a canoe not having a stern mooring ring fixed to the stem.

Drawing 5

Figure 10:
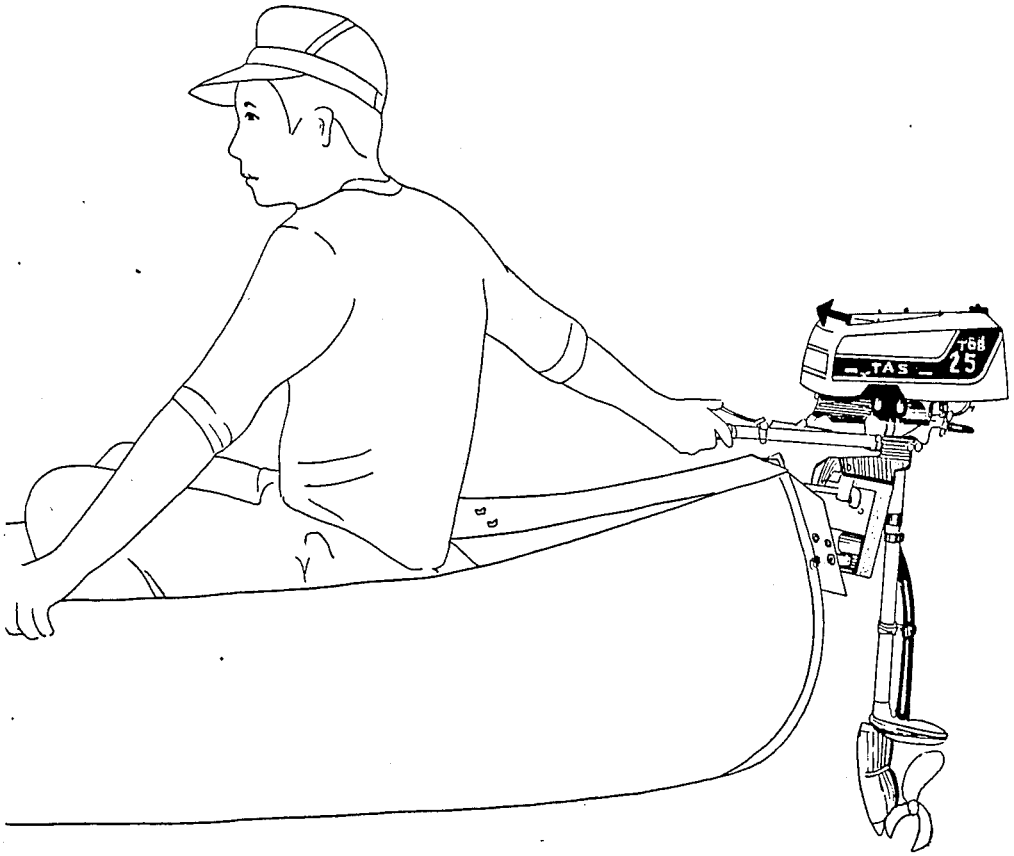

FIG. 10 is a perspective view of the stern section of a double-end canoe with a small outboard motor mounted at center stern using a typical Outboard Motor Mount described in this specification.

DETAILED DESCRIPTION WITH REFERENCE BEING MADE TO THE FIVE SHEETS OF DRAWINGS FORMING A PART HEREOF (The drawings in this specifications are typical.

Similar articles conform to the variously shaped sterns of the various types and makes of double-end canoes)

Drawing 1

FIG. 1

A double-end canoe such as that illustrated normally is propelled by the human effort of paddling. If one desires to use an outboard motor there is a problem - outboard motor mounts commercially available generally clamp to the side of the canoe. Both safety and efficiency leave much to be desired with a side mounted arrangement.

FIG. 2

This invention is a Center Stern Outboard Motor Mount For Double-End Canoes. Hereafter in this Description it will be referred to simply as "Mount". It can be made of aluminum or fibre glass or other suitable material which is compatible with the material of the canoe for which it is made. A model was made for a Grumman aluminum double-end canoe from a single piece of elongated rigid aluminum plate and a block of wood, plus bolts, wings nuts, washers, a steel peg and two short pieces of PVC pipe. The bends and curves of the Mount conform to the profile of the stern deck and stem of the canoe for which it is made.

Part 1: The extreme forward section of the Mount has a bend so as to conform around the forward edge of the stern deck. Though this bend is not absolutely functionally necessary, it does help to keep the forward section of the Mount rigidly secured to the canoe deck and also is a smooth form for terminating the Mount at the forward end.

Part 2: Wing nutted bolts secure the forward section of the Mount tightly to the top of the deck.

Part 3: A triangular cutout in the Mount helps to keep the Mount rigidly secured on the canoe by seating snugly around the converging point of the stern deck, gunwales and stern.

Part 4: For a canoe with a stern mooring ring fixed to the stem, the ring protrudes thru a cutout in the lower rear section of the Mount.

Part 5: Where aluminum plate is folded back against itself at the lower rear section of the Mount, several bolts or rivets are used to help resist the weight of the outboard motor and hold the folded plate together.

Part 6: A block of suitable material, usually wood, is fastened at the extreme rear end of the Mount. The outboard motor clamps to this block.

Part 7: Spacers slipped over the bolts at the lower part of the block help keep the block rigidly positioned at its proper angle. Two short pieces of PVC plastic pipe serve as spacers on the model.

FIG. 3

This is a typical Mount attached to the stern of a double-end canoe. This and the other drawings in the Specification are based on the model which was made for a Grumman aluminum canoe.

Part 1: The extreme forward section of the Mount conforms around the forward edge of the stern deck.

Part 2: Wing nutted bolts through holes in the stern deck and the Mount secure the Mount tightly against the top of the deck.

Part 6: A wooden block fastened at the extreme rear end of the Mount is the part of the Mount onto which an outboard can be clamped.

Part 10: The stern deck of the canoe.

Part 11: The converging point of the stern deck, gunwales and stem. The Mount seats down around this point.

Drawing 2

FIG. 4

This is a plain top view of a typical Mount attached to the stern of a double-end canoe.

Part 2: Wing nutted bolts through the deck and the Mount hold the Mount tightly against the deck.

Part 6: Wooden block fastened at the extreme rear end of the Mount to which an outboard motor can be clamped.

Part 10: the stern deck of the canoe.

Part 11: The converging point of the stern deck, gunwales and stem protrudes through a cutout in the Mount.

Part 12: Represents the double-end canoe to which a Mount has been attached.

FIG. 5

This is a plain side view of a typical Mount attached to the stern of a double-end canoe.

Part 1: The extreme forward section of the Mount conforms around the forward edge of the stern deck.

Part 2: Wing nutted bolts through holes in the deck and the Mount secure the Mount tightly against the deck.

Part 8: The stern mooring ring, which is fastened to the stem, protrudes through a cutout in the Mount.

Part 9: A strong peg inserted down into the mooring ring secures the lower rear section of the Mount tightly against the stem.

Part 10: The stern deck of the canoe.

Part 11: The converging point of the stern deck, gunwales and stem protrudes through a cutout in the Mount which seats snugly around this point, helping to secure the Mount rigidly on the canoe.

Drawing 3

FIG. 6

This is a plain rear view of a typical Mount attached to the stern of a double-end canoe.

Part 6: The wooden block fastened at the extreme rear end of the Mount to which an outboard motor can be clamped.

Part 8: The stern mooring ring protruding through a cutout in the Mount.

Part 9: A strong peg inserted down into the mooring ring secures the Mount tightly against the stem.

Part 11: The converging point of the stern deck, gunwales and stem protrudes through a cutout in the Mount which seats around this point, helping to secure the Mount rigidly on the canoe.

FIG. 7

This figure illustrates a typical Mount attached to the stern of a double-end canoe employing an Accessory Deck Plate and two taut lines, one on each side of the canoe from the Deck Plate to the lower rear section of the Mount to secure the Deck Plate tightly against the top of the deck. The forward end of the Deck Plate has a bend so as to conform around the forward edge of the deck. It has two holes, one at each side, to which the two taut lines are fastened. An Accessory Deck Plate is used for applications of the Mount which do not allow for holes to be made in the stern deck. The Mount is bolted to the Deck Plate just as it other wise would be bolted to the deck.

Part 1: The extreme forward end of the Mount conforms around the forward end of the Accessory Deck Plate.

Part 2: Wing nutted bolts through the Accessory deck Plate and the Mount secure the Mount tightly against the deck Plate.

Part 13: An Accessory Deck Plate secured at the forward section of the stern deck holds the forward section of the Mount tightly in place.

Part 14: One of the two lines fastened to the Deck Plate and the lower rear section of the Mount to secure the Deck Plate in place on top of the stern deck. The lines are made taut by a stiff spring or turnbuckle or other suitable device.

Part 15: One of two holes in the lower rear section of the Mount to which the taut lines securing the Accessory Deck Plate are fastened.

Part 16: One of two holes in the Accessory Deck Plate to which the taut lines securing the Deck Plate in place are fastened.

Drawing 4

FIG. 8

This is a typical Accessory Deck Plate, normally made of the same material as the Mount. It fits over the extreme forward section of the stern deck.

Part 13: The Accessory Deck Plate. The extreme forward end has a bend which conforms around the forward edge of the stern deck. It has one or more holes in its center section so that it and the Mount can be bolted together. It has a hole at each side to which two taut lines are fastened to hold the Deck Plate in place on the deck.

Part 14: A line which fastens to the Accessory Deck Plate and the lower rear section of the Mount in order to hold the Deck Plate (and the Mount bolted to it) in place on the forward stern deck.

Part 16: One of the two holes at the sides of the Accessory Deck Plate for fastening the two lines which hold it in place on the deck.

Part 17: One of two holes in the center section of the Accessory Deck Plate for the bolts which hold the Deck Plate and the Mount tightly together

FIG. 9

This illustrates a typical Mount attached to the stern of a double-end canoe employing two taut lines hooked over the gunwales and fastened to the lower rear section of the Mount to secure the Mount tightly against the stem on a canoe not having a stern mooring ring fixed to the stem.

Part 14: One of two taut lines, employing a stiff spring or turnbuckle or other such device, which fastens to the lower rear section of the Mount and is hooked over the gunwale at a forward corner of the stern deck.

Part 15: One of two holes in the lower rear section of the Mount to which the taut lines are fastened.

Part 18: One of two hooks fastened over the gunwales at the forward corners of the rear deck to which is fastened the taut lines which hold the lower rear section of the Mount tightly against the stem.

Drawing 5

FIG. 10

This illustrates an outboard motor mounted at center stern on a double-end canoe using a typical Mount described in this Specification.

I claim:

1. A center stern mounting for supporting a motor on a canoe having its sides converging and forming the canoe hull and terminating to form a pointed stern rear edge, the mounting comprising, a mounting member in the form of a single elongated rigid plate extending longitudinally of the canoe from a position forward of the pointed stern rear edge to a position rearward of the pointed stern rear edge, the member including an opening to allow the pointed stern rear edge to protrude therethrough, the member including a downward first bend directly forward of the opening, including a second downward bend directly rearward of the opening, the mounting member including a rearmost upwardly extending section, a motor mounting block being attached to the rearmost upwardly extending section, a third bend in the mounting member at a forwardmost section of the member to engage the canoe deck or otherwise to engage a canoe deck plate, and fastening means to retain the mounting member on the canoe.

2. The mounting of claim 1 wherein the fastening means includes bolts to attach a forward section of the mounting member to the canoe deck on applications to canoes of a type wherein said deck does not form the top of an airtight flotation tank.

3. The mounting of claim 1 wherein the fastening means atatches a forward section of the mounting member to an accessory deck plate on applications to canoes of a type wherein the canoe deck forms the top of an airtight flotation tank.

4. The mounting of claim 3 wherein said deck plate is a rectangular rigid plate extending laterally of the forwardmost section of the canoe deck, the deck plate including a bend at a forwardmost section of the plate to engage the canoe deck, the plate including means for fastening to the forward section of the mounting member, and the fastening means being in the form of two taut lines being attached at each side of the plate.

5. The mounting of claim 1 wherein the mounting member has an opening in its downwardly extending rear section to allow a canoe mooring ring to protrude therethrough.

6. The mounting of claim 5, including a common peg or snap inserted into said mooring rig protruding out through said mooring opening in the mounting member.

7. The mounting of claim 1 wherein the fastening means includes taut lines fastened to the downwardly extending rear section of the mounting member, one at each side of the member, said taut lines being fastened to the sides of the deck plate.

8. The mounting of claim 1 wherein the fastening means includes two taut lines fastened to the downwardly extending rear section of the mounting member, one at each side of the member, said taut lines employing hooks to allow hooking over the canoe sides.

9. The mounting of claim 7 or 8 including said taut lines employing a fastener along their lengths.

10. The mounting of claim 1 including said motor mounting block being attached to the rearmost upwardly extending section of the mounting member by bolts and spacers.

* * * * *